US007316224B2

(12) United States Patent
Chae

(10) Patent No.: US 7,316,224 B2
(45) Date of Patent: Jan. 8, 2008

(54) METHOD FOR DETECTING LIQUEFIED FUEL IN CANISTER PURGE LINE OF VEHICLE

(75) Inventor: Seung-Jin Chae, Seoul (KR)

(73) Assignee: Hyundai Motor Company, Seoul (KR)

( * ) Notice: Subject to any disclaimer, the term of this patent is extended or adjusted under 35 U.S.C. 154(b) by 38 days.

(21) Appl. No.: 11/483,575

(22) Filed: Jul. 10, 2006

(65) Prior Publication Data

US 2007/0131204 A1 Jun. 14, 2007

(30) Foreign Application Priority Data

Dec. 13, 2005 (KR) ..... 10-2005-0122725

(51) Int. Cl.
*F02M 33/02* (2006.01)

(52) U.S. Cl. ..... 123/520; 123/198 D; 123/516

(58) Field of Classification Search ..... 123/520, 123/516, 518, 519, 198 D
See application file for complete search history.

(56) References Cited

U.S. PATENT DOCUMENTS 3,884,204 A 5/1975 Krautwurst et al.
6,269,803 B1 * 8/2001 Corkill ..... 123/520
6,561,166 B2 * 5/2003 Halleron et al. ..... 123/519
6,689,196 B2 * 2/2004 Amano et al. ..... 96/112

FOREIGN PATENT DOCUMENTS

| | | |
|---|---|---|
| JP | 5126004 | 5/1993 |
| JP | 6235346 | 8/1994 |
| JP | 11287160 | 10/1999 |
| JP | 2004-068738 | 3/2004 |

* cited by examiner

*Primary Examiner*—Stephen K. Cronin
*Assistant Examiner*—Katrina B. Harris
(74) *Attorney, Agent, or Firm*—Morgan Lewis & Bockius LLP

(57) ABSTRACT

A method of detecting whether liquefied fuel exists in a canister purge line includes, if a fuel level in a fuel tank is higher than a pre-set level, opening a purge control valve for a time. A difference is calculated between the air-fuel ratio before and after opening the purge control valve. If the difference is less than or equal to a first value and the air-fuel ratio after opening the purge control valve is less than or equal to a second value, then it is deemed that liquefied fuel exists in the canister purge line. If liquefied fuel is deemed to exist in the canister purge line, the purge control valve may be closed for a certain amount of time.

10 Claims, 2 Drawing Sheets

METHOD FOR DETECTING LIQUEFIED FUEL IN CANISTER PURGE LINE OF VEHICLE

CROSS-REFERENCE TO RELATED APPLICATIONS

The present application is based on, and claims priority from, Korean Application Serial Number 10-2005-0122725, filed on Dec. 13, 2005, the disclosure of which is hereby incorporated by reference herein in its entirety.

FIELD OF THE INVENTION

The present invention relates to a method of detecting whether liquefied fuel exists in a canister purge line of a vehicle and, if the liquefied fuel exists, deactivating the operation of a purge control valve, thereby preventing the cease of the engine ignition.

BACKGROUND OF THE INVENTION

An evaporation control system of a vehicle is generally equipped with an activated carbon canister on a fuel tank vapor line. When the engine is running, the evaporation control system returns the fuel vapors collected in the canister to the intake portion of the engine, through a purge line and a purge control valve, under the control of an Electronic Control Unit (ECU).

However, if the fuel tank is overfilled, the fuel level may be up to the canister or the purge line. Provided that the purge control valve is opened after the engine ignition key is turned on, the liquid fuel remaining in the purge line flows into the intake portion of the surge tank, causing a loss of engine power due to an extremely low air-fuel ratio (A/F).

Therefore it would be desirable to detect the presence of liquid fuel in the purge line before engine power is lost, and to control operation of the purge control valve based on whether or not liquid fuel exists in the purge line.

The information disclosed in this Background of the Invention section is only for enhancement of understanding of the background of the invention and should not be taken as an acknowledgement or any form of suggestion that this information forms the prior art that is already known in this country to a person of ordinary skill in the art.

SUMMARY OF THE INVENTION

Embodiments of the present invention detect whether or not liquid fuel exists in a canister purge line of a vehicle. Further embodiments of the present invention close a purge control valve for a pre-set time period if liquid fuel is detected in the canister purge line, thus preventing loss of engine power.

A method of detecting whether liquefied fuel exists in a canister purge line of the vehicle comprises the steps of checking the fuel level in the fuel tank with a fuel tank level sensor. If the fuel level is greater than or equal to a pre-set standard level, the purge control valve is opened for a time, then a difference is calculated between the air-fuel ratio after opening the purge control valve and the air-fuel ratio before opening the purge control valve. Next, the difference between the air-fuel ratios is compared with a pre-set first value, and the air-fuel ratio after the purge control valve was opened is compared with a pre-set second value. If the difference between the air-fuel ratios is less than or equal to the pre-set first value and the air-fuel ratio after opening the purge control valve is less than or equal to the pre-set second value, then it is deemed that liquefied fuel exists in the canister purge line. If liquefied fuel is deemed to exist in the canister purge line, the purge control valve may be closed for a pre-set time period.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Figure 1:
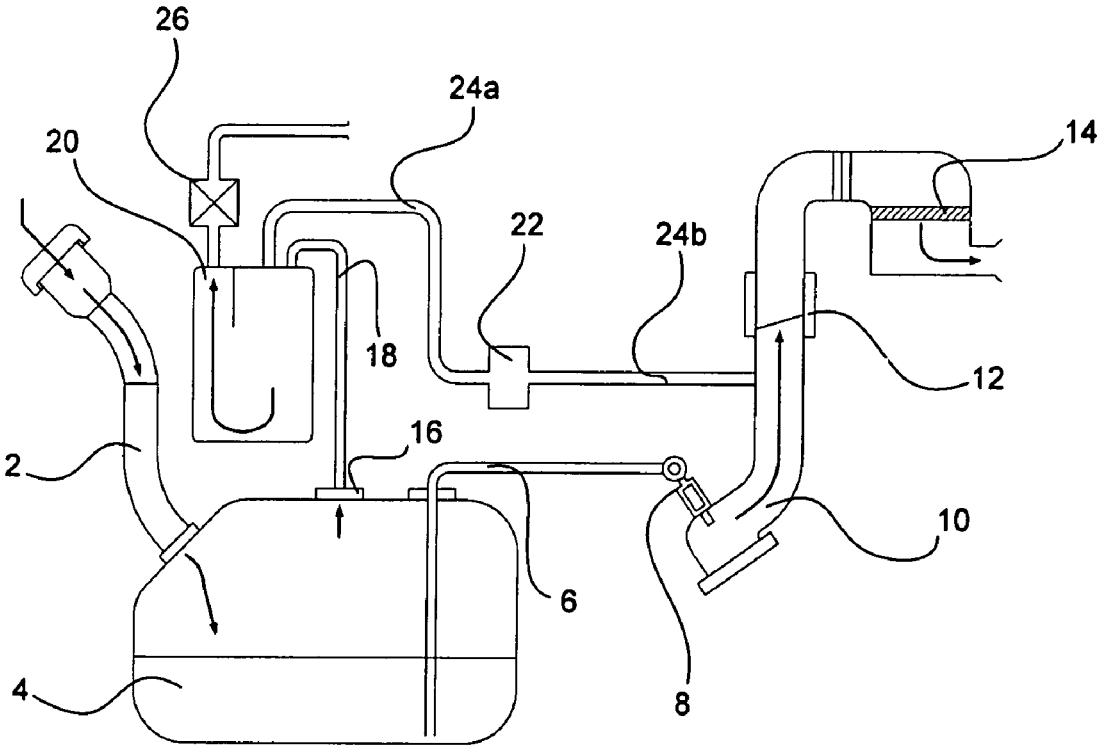
FIG. 1 is a constitutional view depicting a disposition of a canister purge line according to embodiments of the present invention.

Referring to FIG. 1, embodiments of the present invention provide a fuel filler tube 2 into which fuel is inserted by a user. The fuel is stored in fuel tank 4, where it enters into fuel line 6 and is provided to fuel injector 8 which injects it to intake manifold 10, which is provided with a throttle body 12 and air filter 14.

When the vehicle is not running, fuel vapors escape from the fuel tank 4 through fuel tank vapor valve 16 and vapor line 18 to activated carbon canister 20, where they are stored. When the ignition is turned on, purge control valve 22 (which may, in some embodiments, be a solenoid valve) is selectively opened as will be described below, allowing the vapors to be supplied to intake manifold 10 through purge lines 24*a*, 24*b*.

If the fuel tank 4 is overfilled, liquid fuel may accumulate in activated carbon canister 20 or purge line 24*a*. If this liquid fuel were to make its way to purge line 24*b*, it would enter into the combustion chamber due to negative pressure of the intake during purge control of the ECU, inducing a low A/F and loss of engine power.

Figure 2:
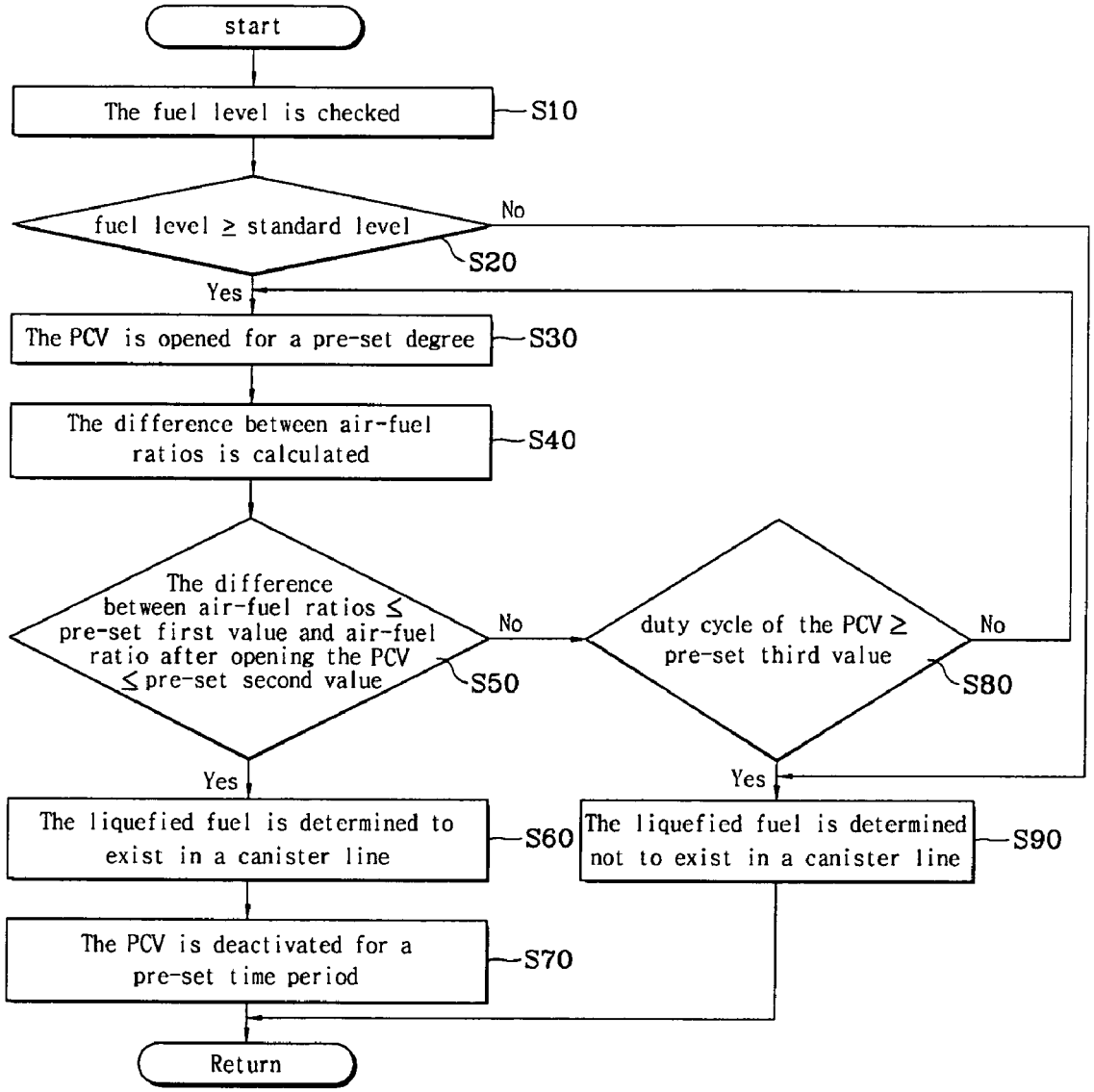
FIG. 2 is a flowchart depicting a method of detecting liquefied fuel in a canister purge line according to embodiments of the present invention.

Referring to FIG. 2, a method of detecting whether liquefied fuel exists in a canister purge line of a vehicle includes checking the fuel level in a fuel tank with a fuel tank level sensor at step S10 and comparing it with a pre-set standard level (for example, 90% of the tank's maximum fuel level) at step S20.

If the fuel level is less than the standard level at step S20, liquid fuel is deemed not to exist in the canister line at step S90 and the system returns to the initial step of monitoring the fuel level at step S10.

If the fuel level measured at step S10 is greater than or equal to the pre-set standard level, an air ratio λ is measured by an oxygen sensor in the exhaust manifold or exhaust pipe. The air ratio λ is a measure of excess air, and is defined by (actual air/fuel ratio)/(theoretical air/fuel ratio). The purge control valve (PCV) is then opened for a pre-set time period in step S30 (for example, the duty cycle may be 1%). λ is measured again, and a difference is calculated between the two: (λ after opening the purge control valve)-(λ before opening the purge control valve), in step S40.

Next, in step S50, the difference between the air ratios calculated in S40 is compared with a pre-set first value. The pre-set first value may be between −0.4 and 0, for example, −0.2. The air ratio after the purge control valve is opened for the pre-set degree is compared with a pre-set second value. The pre-set second value may be between 0.6-1, for example 0.7.

If the difference between the air ratios is less than or equal to the pre-set first value and the air ratio after opening the purge control valve for the pre-set degree is less than or equal to the pre-set second value as a result of S50, then it is deemed that liquefied fuel exists in the canister purge line at step S60; the purge control valve may then be closed by the control of an Electronic Control Unit (ECU). The ECU may comprise a processor, memory and associated hardware, software and/or firmware as may be selected and programmed by a person of ordinary skill based on the teachings contained herein.

The purge control valve remains closed for a pre-set period of time in step S70. The pre-set period of time should be long enough to delay any other control of the engine until the engine is stable (for example, approximately four seconds), and whether the liquefied fuel exists in the line is re-monitored at step S10. This prevents a power loss of the engine even if the fuel tank is overfilled.

If the difference between the air ratios exceeds the pre-set first value or the air ratio after opening the purge control valve exceeds the pre-set second value as a result of step S50, and the duty cycle of the purge control valve is greater than or equal to a pre-set third value (for example, 5%-15%) as a result of step S80, then it is determined that liquid fuel does not exist in the canister purge line at step S90, and thus the system returns to the initial step of monitoring the fuel level at step S10.

Thus, loss of engine power due to a low A/F, which is caused by liquefied fuel in the canister purge line during control of canister purge, is prevented by detecting liquefied fuel in the canister purge line in advance.

The technical concept of the present invention is not limited to the above embodiments but should be determined by a logical interpretation on the basis of the claims of the present invention.

As apparent from the foregoing, there is an advantage in that if the liquefied fuel exists in the canister purge line, the purge control valve may be closed for a pre-set period of time, thereby avoiding a loss of engine power due to a low A/F.

What is claimed is:

1. A method of detecting whether liquefied fuel exists in a canister purge line of a vehicle, comprising:

measuring a fuel level in a fuel tank;

if said fuel level is greater than or equal to a pre-set fuel level, measuring a first air ratio;

opening a purge control valve for a pre-set time after said measuring of said first air ratio;

measuring a second air ratio after said opening of said purge control valve;

subtracting said first air ratio from said second air ratio to obtain a difference; and if said difference is less than or equal to a pre-set first value and said second air ratio is less than or equal to a pre-set second value, deeming that liquefied fuel exists in said canister purge line.

2. The method as defined in claim 1, further comprising if the liquefied fuel is deemed to exist in the canister purge line, closing said purge control valve.

3. The method as defined in claim 1, wherein said pre-set fuel level is approximately 90% of a maximum fuel level of said fuel tank.

4. The method as defined in claim 1, wherein if said fuel level is greater than or equal to said pre-set fuel level, a duty cycle of said purge control valve is approximately 1%.

5. The method as defined in claim 1, further comprising if said difference exceeds said pre-set first value and a duty cycle of said purge control valve is greater than or equal to a pre-set third value, deeming that liquefied fuel does not exist in the canister purge line.

6. The method as defined in claim 1, further comprising if said second air ratio exceeds said pre-set second value and a duty cycle of said purge control valve is greater than or equal to a pre-set third value, deeming that liquefied fuel does not exist in the canister purge line.

7. The method as defined in claim 1, further comprising if said fuel level is less than said pre-set fuel level, deeming that liquefied fuel does not exist in the canister purge line.

8. The method as defined in claim 2, wherein if liquefied fuel is deemed to exist in the canister purge line, said purge control valve is closed for a pre-set period of time.

9. The method as defined in claim 8, wherein said pre-set period of time is approximately four seconds.

10. The method as defined in claim 1, wherein said purge control valve comprises a solenoid valve.

* * * * *